US007495530B2

(12) United States Patent
Shih

(10) Patent No.: US 7,495,530 B2
(45) Date of Patent: Feb. 24, 2009

(54) DUAL-BAND FILTER

(75) Inventor: Yen-Yi Shih, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 91 days.

(21) Appl. No.: 11/309,632

(22) Filed: Sep. 1, 2006

(65) Prior Publication Data

US 2007/0146100 A1 Jun. 28, 2007

(30) Foreign Application Priority Data

Dec. 23, 2005 (TW) ..... 94146338 A

(51) Int. Cl.
*H01P 1/20* (2006.01)

(52) U.S. Cl. ..... 333/204; 333/203; 333/202

(58) Field of Classification Search ..... 333/202–204
See application file for complete search history.

(56) References Cited

U.S. PATENT DOCUMENTS

| | | | | |
|---|---|---|---|---|
| 4,253,073 | A * | 2/1981 | Stegens | 333/203 |
| 5,543,758 | A | 8/1996 | Wey | |
| 6,778,042 | B2 * | 8/2004 | Terashima et al. | 333/205 |
| 6,819,204 | B2 * | 11/2004 | Grunewald | 333/204 |
| 6,823,201 | B2 | 11/2004 | Kai et al. | |
| 2003/0222736 | A1 * | 12/2003 | Allison | 333/204 |
| 2004/0246077 | A1 * | 12/2004 | Misu et al. | 333/195 |

FOREIGN PATENT DOCUMENTS

| | | |
|---|---|---|
| CN | I309823 A | 8/2001 |
| TW | I239116 | 9/2005 |

OTHER PUBLICATIONS

Sheng Sun, Lei Zhu, "Compact Dual-Band Microstrip Bandpass Filter Without External Feeds", IEEE Microwave and Wireless Components Letters, Oct. 2005, pp. 644-646, vol. 15, Issue 10, IEEE.

Jen-Tsai Kuo, Tsung-Hsun Yeh, and Chun-Cheng Yeh, "Design of Microstrip Bandpass Filters With A Dual-Passband Response", IEEE Transactions on Microwave Theory and Techniques, Apr. 2005, pp. 1331-1337, vol. 53, Issue 4, IEEE.

Qiang Sui, Melzhen Jin, Yidong Wang, Yanjun Ma, Qingxin Guo, Li Zhang and Jilong Ju, "Dual-Mode L-Band Bandpass Filter With Cross Couplings And Absorbing Resonators", Microwave Conference Proceedings, APMC 2005, Asia-Pacific Conference Proceedings, Dec. 2005, 3 Pages, vol. 5, IEEE.

* cited by examiner

*Primary Examiner*—Vibol Tan
(74) *Attorney, Agent, or Firm*—Wei Te Chung

(57) ABSTRACT

A dual-band filter (10) is provided. The dual-band filter includes an input line (100), a first transmission line (140), a second transmission line (160), a third transmission line (180), and an output line (120). The input line is used for inputting electromagnetic signals. The first transmission line is electronically connected to the input line. The second transmission line is arranged parallel to the first transmission line. The third transmission line is arranged between, and parallel to, the first transmission line and the second transmission line. The output line for outputting electromagnetic signals, is arranged parallel to the input line, and is electronically connected to the second transmission line.

15 Claims, 2 Drawing Sheets

DUAL-BAND FILTER

FIELD OF THE INVENTION

The present invention generally relates to filters, and more particularly to a dual-band filter.

DESCRIPTION OF RELATED ART

In recent years, there has been a significant growth in WLAN (wireless local area network) technology due to the increasing demand of wireless communication products. Such growth becomes particularly prominent after promulgation of an IEEE 802.11 WLAN protocol in 1997. The IEEE 802.11 WLAN protocol not only offers many novel features to current wireless communications, but also provides a solution of enabling two wireless communication products manufactured by different companies to communicate with each other. As such, the promulgation of the IEEE 802.11 WLAN protocol is a milestone in the development of WLAN. Moreover, the IEEE 802.11 WLAN protocol ensures that a core device is the only solution of implementing a single chip. Thus, the IEEE 802.11 WLAN protocol can significantly reduce the cost of adopting wireless technology, so as to enable WLAN to be widely employed in various wireless communication products. At present, there are two versions of the IEEE 802.11 WLAN protocol, one for 5.0 GHz, and the other for 2.45 GHz.

Conventionally, electromagnetic signals are generated when a wireless communication product, such as an access point complying with IEEE 802.11 WLAN protocol, transfers data at high power, and these electromagnetic signals may cause electromagnetic interference (EMI).

For solving the above problem, some manufacturers in the art use a waveguide element, such as a microstrip, to act as a filter. The microstrip filter is formed on a printed circuit board to diminish harmonic electromagnetic signals, however the filter is configured to work for only one or the other protocol versions.

Therefore, a need exists in the industry for a filter that can be used for the two versions of the IEEE 802.11 WLAN protocol.

SUMMARY OF THE INVENTION

A dual-band filter is provided. The dual-band filter includes an input line, a first transmission line, a second transmission line, a third transmission line, and an output line. The input line is used for inputting electromagnetic signals. The first transmission line is electronically connected to the input line. The second transmission line is arranged parallel to the first transmission line. The third transmission line is arranged between, and parallel to, the first transmission line and the second transmission line. The output line for outputting electromagnetic signals, is arranged parallel to the input line, and is electronically connected to the second transmission line.

Other objectives, advantages and novel features of the present invention will be drawn from the following detailed description of preferred embodiments of the present invention with the attached drawings, in which:

DETAILED DESCRIPTION OF THE INVENTION

Figure 1:
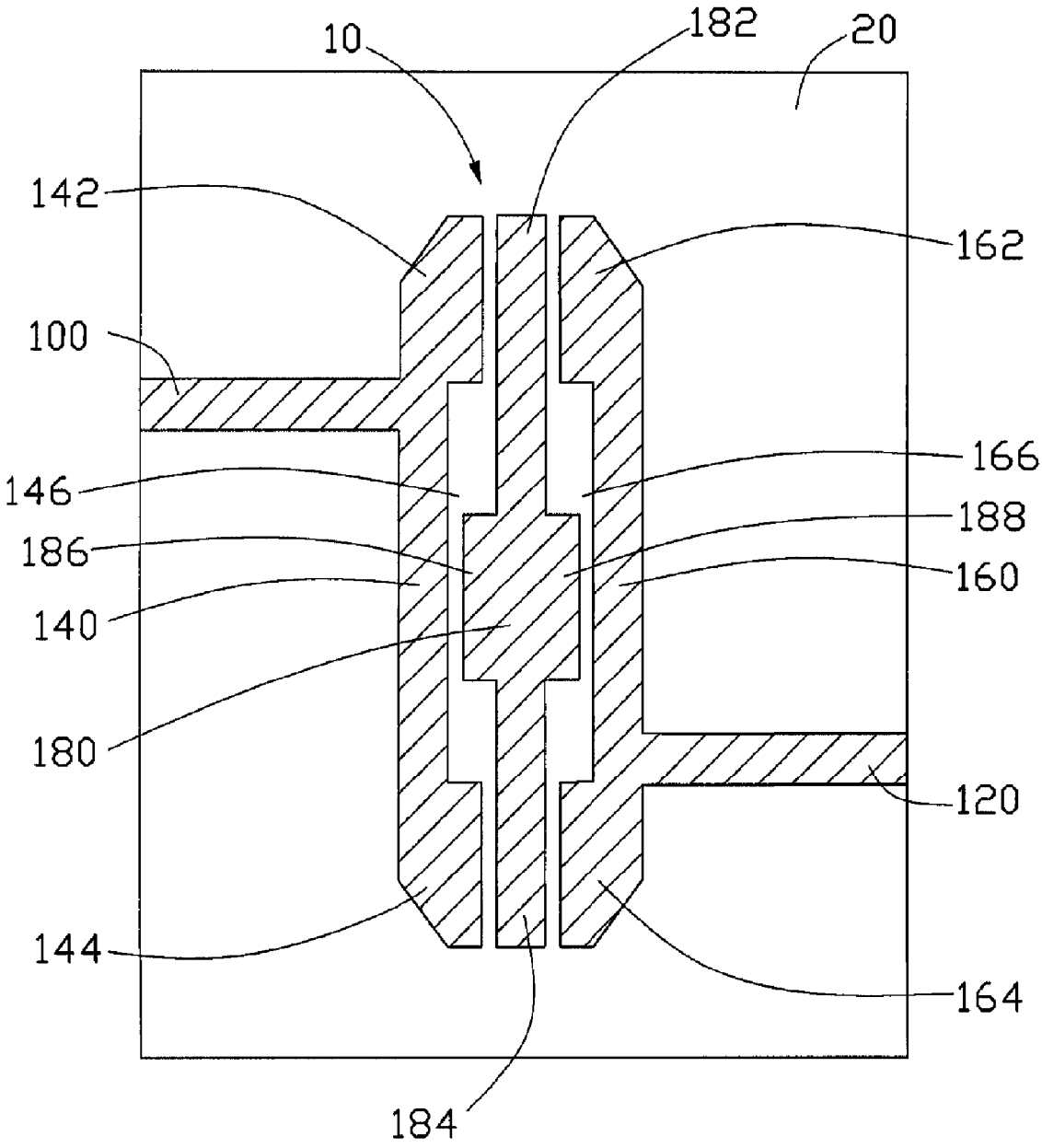
FIG. 1 is a schematic diagram of a dual-band filter of an exemplary embodiment of the invention.

FIG. 1 is a schematic diagram of an exemplary dual-band filter 10 of the present invention.

The dual-band filter 10, printed on a substrate 20, is used for cutting out harmonic electromagnetic signals. The dual-band filter 10 includes an input line 100, an output line 120, a first transmission line 140, a second transmission line 160, and a third transmission line 180.

The input line 100 is used for inputting electromagnetic signals. The output line 120 is used for outputting electromagnetic signals. The output line 120 is arranged parallel to the input line 100, and is electronically connected to the second transmission line 160. Impedances of the input line 100 and the output line 120 are approximately equal to 50 ohms.

The first transmission line 140 is electronically connected to the input line 100. The first transmission line 140 includes a first free end 142, a second free end 144, and a first recessed portion 146. The first recessed portion 146 is arranged between the first free end 142 and the second free end 144, and is formed between the first transmission line 140 and the third transmission line 180.

The second transmission line 160 is symmetrical and parallel to the first transmission line 140. The shape, length, and width of the first transmission line 160 are the same as those of the second transmission line 140. The second transmission line 160 includes a third free end 162, a fourth free end 164, and a second recessed portion 166. The second recessed portion 166, defined opposite to the first recessed portion 146, is arranged between the third free end 162 and the fourth free end 164, and is formed between the second transmission line 160 and the third transmission line 180. The third free end 162 faces the first free end 142. The fourth free end 164 faces the second free end 144.

The third transmission line 180 is arranged between, and parallel to, the first transmission line 140 and the second transmission line 160. The first transmission line 140 and the second transmission line 160 are symmetrical to the third transmission line 180. The third transmission line 180 includes a fifth free end 182, a sixth free end 184, a first protrusion 186, and a second protrusion 188. The fifth free end 182 is located between the first free end 142 and the third free end 162. The sixth free end 184 is located between the second free end 144 and the fourth free end 164. The first protrusion 186 extends into a part of the first recessed portion 146. The second protrusion 188 extends into a part of the second recessed portion 166.

Figure 2:
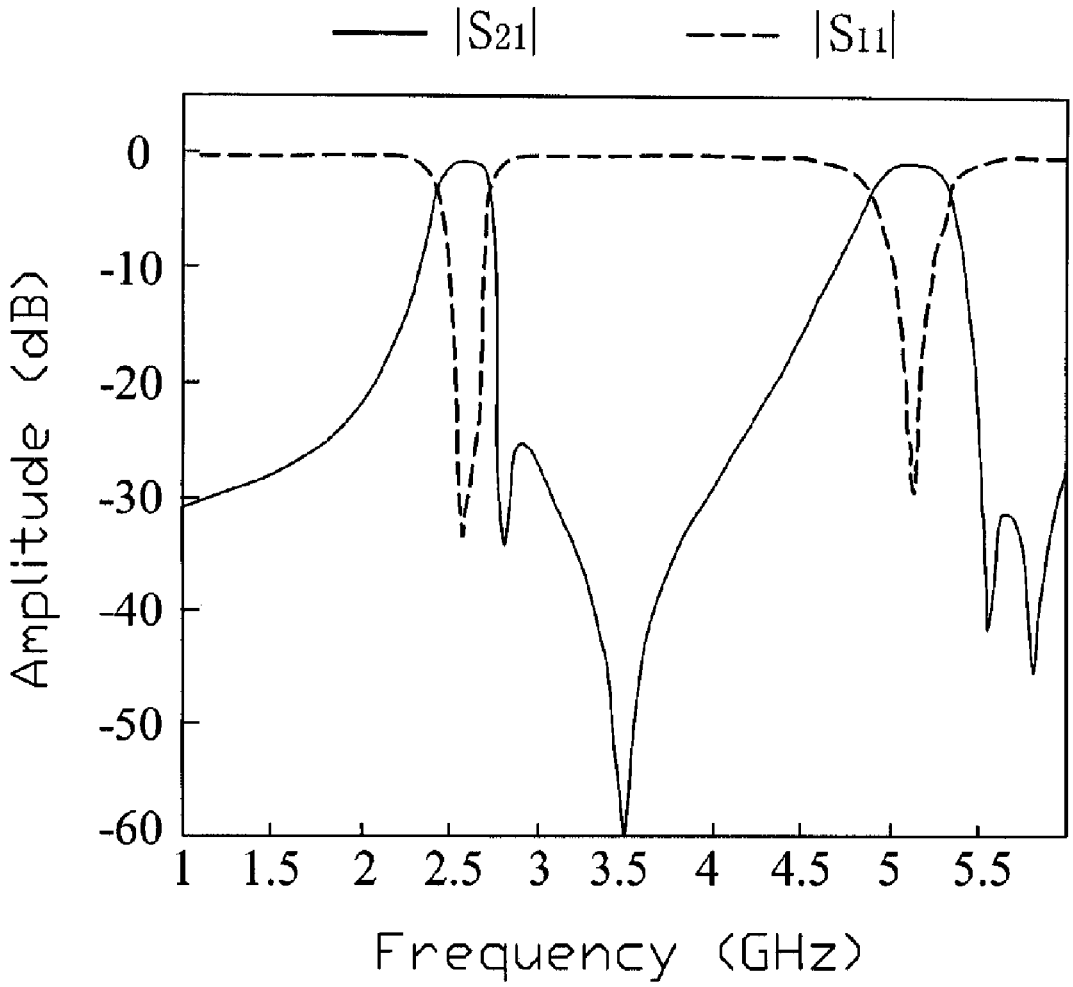
FIG. 2 is a graph of a curve showing a relationship between insertion/return loss and frequency of electromagnetic signals traveling through the dual-band filter.

FIG. 2 is a graph of curve showing a relationship between an insertion or return loss and frequency of an electromagnetic signal traveling through the dual-band filter 10. The horizontal axis represents the frequency (in GHz) of the electromagnetic signal traveling through the dual-band filter 10, and the vertical axis represents the insertion or return loss (in dB) of the dual-band filter 10. The insertion loss of an electromagnetic signal traveling through the dual-band filter 10 is indicated by the curve labeled S21 and indicates a relationship between input power and output power of the electromagnetic signals traveling through the dual-band filter 10, and is represented by the following equation:

$$\text{Insertion Loss} = -10 * Lg[(\text{Input Power})/(\text{Output Power})].$$

When the electromagnetic signals travel through the dual-band filter 10, a part of the input power is returned to a source of the electromagnetic signals. The part of the input power returned to the source of the electromagnetic signal is called return power. The return loss of an electromagnetic signal traveling through the dual-band filter 10 is indicated by the curve labeled S11 and indicates a relationship between the input power and the return power of the electromagnetic signal traveling through the dual-band filter 10, and is represented by the following equation:

$$\text{Return Loss}=-10*Lg[(\text{Input Power})/(\text{Return Power})].$$

For a filter, when the output power of the electromagnetic signal in a band-pass frequency range is close to the input power thereof, and the return power of the electromagnetic signal is relatively small, it means that a distortion of the electromagnetic signal is small and the performance of the dual-band filter is good. That is, the smaller the absolute value of the insertion loss of the electromagnetic signal is, the greater the absolute value of the return loss thereof is, and the better the performance of the filter is. As shown in FIG. 2, the absolute value of the insertion loss of the electromagnetic signal in the band-pass frequency range is close to 0, and the absolute value of the return loss of the electromagnetic signal is greater than 10, and therefore, the dual-band filter 10 has good performance.

Because the input line 100 and the output line 120 of the dual-band filter 10 have matching impedances of 50 ohms, impedance converters are not required, thus minimizing a size of the dual-band filter 10 and saving space on the substrate 20. The first transmission line 140 and the second transmission line 160 are arranged parallel to the third transmission line 180 to achieve a good performance and minimize the space occupied by the dual-band filter 10 by changing equivalent phase constants of the transmission line and distances between the transmission line.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A dual-band filter, comprising:

an input line for inputting electromagnetic signals;

a first transmission line electronically connected to the input line;

a second transmission line arranged parallel to the first transmission line;

a third transmission line arranged between, and parallel to, the first transmission line and the second transmission line, wherein the third transmission line comprises a first protrusion and a second protrusion; and an output line arranged parallel to the input line and electronically connected to the second transmission line, for outputting the electromagnetic signals;

wherein the first transmission line comprises a first free end, a second free end, and a first recessed portion arranged between the first free end and the second free end, the second transmission line comprises a third free end, a fourth free end and a second recessed portion arranged between the third free and the fourth free end, the first recessed portion is defined opposite to the second recessed portion, the first protrusion extends into a part of the first recessed portion, and the second protrusion extends into a part of the second recessed portion.

2. The dual-band filter as recited in claim 1, wherein impedances of the input line and the output line are substantially equal to 50 ohms.

3. The dual-band filter as recited in claim 1, wherein the shape, length, and width of the first transmission line are the same as those of the second transmission line.

4. The dual-band filter as recited in claim 1, wherein the first transmission line and the second transmission line are symmetrical to the third transmission line.

5. The dual-band filter as recited in claim 4, wherein the first recessed portion is formed between the first transmission line and the third transmission line.

6. The dual-band filter as recited in claim 4, wherein the second recessed portion is formed between the second transmission line and the third transmission line.

7. The dual-band filter as recited in claim 4, wherein the third free end faces the first free end.

8. The dual-band filter as recited in claim 4, wherein the fourth free end faces the second free end.

9. The dual-band filter as recited in claim 4, wherein the third transmission line comprises a fifth free end located between the first free end and the third free end.

10. The dual-band filter as recited in claim 9, wherein the third transmission line further comprises a sixth free end located between the second free end and the fourth free end.

11. A filter comprising:

an input line for inputting electromagnetic signals into said filter;

an output line spaced from said input line for outputting said electromagnetic signals out of said filter;

a first transmission line electrically connectable with said input line for signal communication therewith and extend along a preset direction;

a second transmission line electrically connectable with said output line for signal communication therewith, said second transmission line extending along said preset direction to be substantially parallel to said first transmission line and spaced from said first transmission line; and a third transmission line arranged to intervene between said first and second transmission lines to establish signal communication between said first and second transmission lines, and spaced from said first and second transmission lines respectively, said third transmission line extending along said preset direction to be substantially parallel to said first transmission line, and comprising at least one protrusion extending away from said third transmission line toward at least one of said first and second transmission lines;

wherein said at least one of said first and second transmission lines defines a recessed portion forming to face said third transmission line corresponding to said at least one protrusion, and said at least one protrusion of said third transmission line extends into said recessed portion and keeps spaced from said at least one of said first and second transmission lines.

12. A filter comprising:

an input line for inputting electromagnetic signals into said filter;

an output line spaced from said input line for outputting said electromagnetic signals out of said filter;

a first transmission line electrically connectable with said input line for signal communication therewith;

a second transmission line electrically connectable with said output line for signal communication therewith, said second transmission line extending to be spaced from said first transmission line; and a third transmission line arranged to intervene between said first and second transmission lines to establish signal communication between said first and second transmission lines, and extending spaced from said first and second transmission lines respectively, said third transmission line comprising at least one protrusion extending away from said third transmission line toward at least one of said first and second transmission lines;

wherein a first gap is defined to extend between said third transmission line and a free end of said at least one of said first and second transmission lines, and a second gap is defined to extend between said at least one of said first and second transmission lines and at least one protrusion of said third transmission line, said first and second gaps are offset from each other.

13. The filter as recited in claim 12, wherein said at least one of said first and second transmission lines defines a recessed portion forming to face said third transmission line corresponding to said at least one protrusion, and said at least one protrusion of said third transmission line extends into said recessed portion and keeps spaced from said at least one of said first and second transmission lines.

14. The dual-band filter as recited in claim 1, wherein a first gap is defined to extend between the third transmission line and the first free end of the first transmission line, and a second gap is defined to extend between the first transmission line and the first protrusion of the third transmission line, the first gap and the second gap are offset from each other.

15. The filter as recited in claim 11, wherein a first gap is defined to extend between said third transmission line and a free end of said at least one of said first and second transmission lines, and a second gap is defined to extend between said at least one of said first and second transmission lines and said at least one protrusion of said third transmission line, said first and second gaps are offset from each other.

* * * * *